US008066529B2

(12) United States Patent
Kim et al.

(10) Patent No.: US 8,066,529 B2
(45) Date of Patent: Nov. 29, 2011

(54) CONDENSER CONNECTOR FOR VEHICLE

(75) Inventors: Ji Hyoung Kim, Incheon (KR); Jong Wook Lee, Gunpo Gyeonggi-Do (KR); Jong Hyun Lee, Suwan (KR); Sung Ho Heo, Seoul (KR)

(73) Assignees: Hyundai Motor Company, Seoul (KR); Korea Electric Terminal Co., Ltd., Incheon (KR)

( * ) Notice: Subject to any disclaimer, the term of this patent is extended or adjusted under 35 U.S.C. 154(b) by 0 days.

(21) Appl. No.: 12/758,372

(22) Filed: Apr. 12, 2010

(65) Prior Publication Data

US 2011/0104947 A1 May 5, 2011

(30) Foreign Application Priority Data

Oct. 30, 2009 (KR) ..... 10-2009-0103943

(51) Int. Cl.
*H01R 13/66* (2006.01)

(52) U.S. Cl. ..... 439/620.05

(58) Field of Classification Search . 439/620.05–620.35
See application file for complete search history.

(56) References Cited

U.S. PATENT DOCUMENTS 5,290,191 A * 3/1994 Foreman et al. ..... 439/225
6,478,626 B2 * 11/2002 Dingenotto et al. ..... 439/620.14
6,554,649 B2 * 4/2003 Pade ..... 439/620.17

* cited by examiner

*Primary Examiner* — Phuong Dinh
(74) *Attorney, Agent, or Firm* — Edwards Angell Palmer & Dodge LLP; Peter F. Corless

(57) ABSTRACT

Disclosed herein is a condenser connector for a vehicle, in which a condenser is installed at a position which is nearest or virtually nearest to a noise source, thus effectively eliminating or reducing noise. The condenser connector includes a housing having an insertion part. One end of a terminal is connected to a wire, and the other end thereof is fitted into and secured to one end of the insertion part. A holder is fitted into and secured to the other end of the insertion part. A condenser has a contact terminal which is in contact with the terminal, and is mounted to the holder.

6 Claims, 8 Drawing Sheets

CONDENSER CONNECTOR FOR VEHICLE

CROSS-REFERENCE TO RELATED APPLICATION

This application claims under 35 U.S.C. §119(a) the benefit of Korean Application No. 10-2009-0103943 filed Oct. 30, 2009, the entire contents of which are incorporated herein by reference.

BACKGROUND OF THE INVENTION

1. Field of the Invention

The present invention relates, in general, to condenser connectors for vehicles that can remove or reduce vehicular noise.

2. Description of the Related Art

Generally, a vehicle is provided with a wire harness and a connector to connect power supplied by a battery to various kinds of electric components, for example, an electric component of an engine for the starting and ignition of the engine and an electric component for illumination.

As shown in FIG. 6, a conventional connector 10 includes a male housing 21, a female housing 31, and terminals 24 and 34. A plurality of insertion parts 23 is formed in the male housing 21. The female housing 31 has a structure corresponding to the male housing 21 and is inserted into the male housing 21, with a plurality of insertion parts 33 formed in the female housing 31. The terminals 24 and 34 are inserted into the insertion parts 23 of the male housing 21 and the insertion parts 33 of the female housing 31. That is, in the state where the terminals 24 and 34 are connected, respectively, to wires 25 and 35, the terminals 24 and 34 are inserted into the insertion parts 23 and 33 formed in the male housing 21 and the female housing 31, and thereafter, the female housing 31 is fitted into the male housing 21. Thereby, the wires 25 and 35 are electrically connected to each other.

Further, an engine condenser has been used as the electric component of an engine of a vehicle to eliminate or reduce vehicular noise. However, the conventional engine condenser is problematic in that there are many restrictions on the layout of a vehicle when the engine condenser is used, and the noise eliminating performance of the engine condenser is insufficient.

SUMMARY OF THE INVENTION

Accordingly, the present invention has been made keeping in mind the above problems occurring in the related art, and the present invention is intended to propose a condenser connector for a vehicle, in which a condenser is installed at a position which is nearest or virtually nearest to a noise generating source, thus effectively improving noise eliminating/reducing performance.

In order to achieve the above object, according to one aspect of the present invention, there is provided a condenser connector for a vehicle including a housing, a terminal, a holder, and a condenser. The housing has an insertion part.

One end of the terminal is connected to a wire, and the other end is fitted into and secured to one end of the insertion part. The holder is fitted into and secured to the other end of the insertion part. The condenser has a contact terminal which is in contact with the terminal, and is mounted to the holder.

The above and other aspects of the invention are discussed infra.

BRIEF DESCRIPTION OF THE DRAWINGS

The above and other objects, features and advantages of the present invention will be more clearly understood from the following detailed description when taken in conjunction with the accompanying drawings, in which.

DETAILED DESCRIPTION OF THE INVENTION

Reference will now be made in greater detail to preferred embodiments of the invention, examples of which are illustrated in the accompanying drawings.

Figure 1:
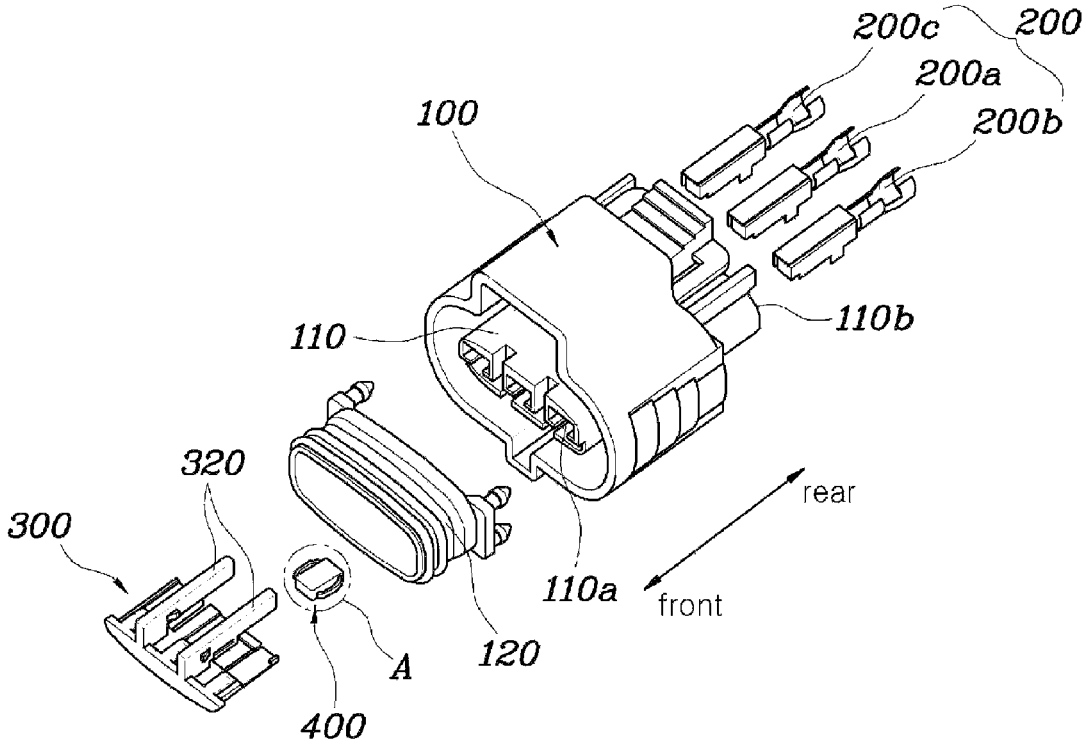
FIG. 1 is an exploded perspective view illustrating a condenser connector for a vehicle according to the present invention.
Figure 2:
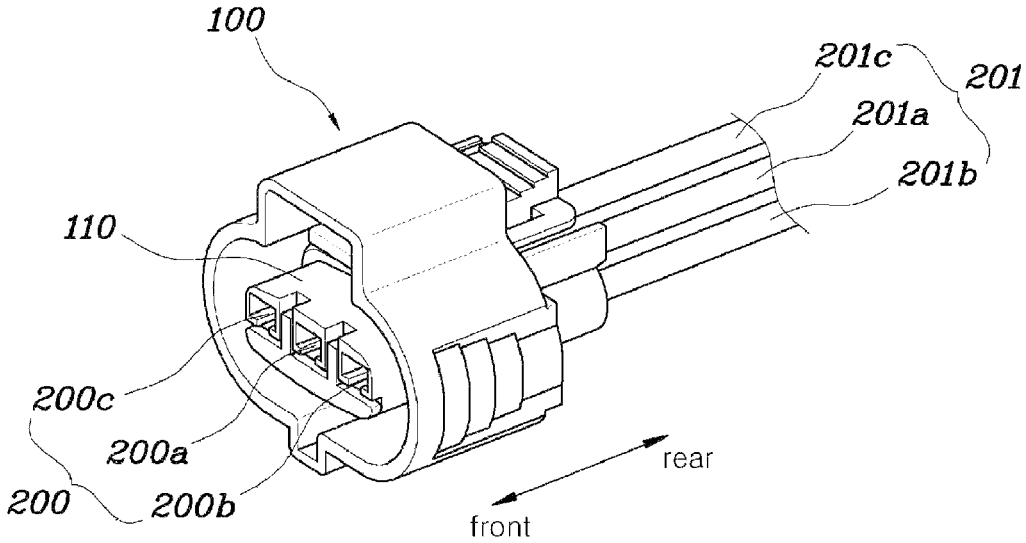
FIG. 2 is a perspective view illustrating the assembled condenser connector according to the present invention.
Figure 3:
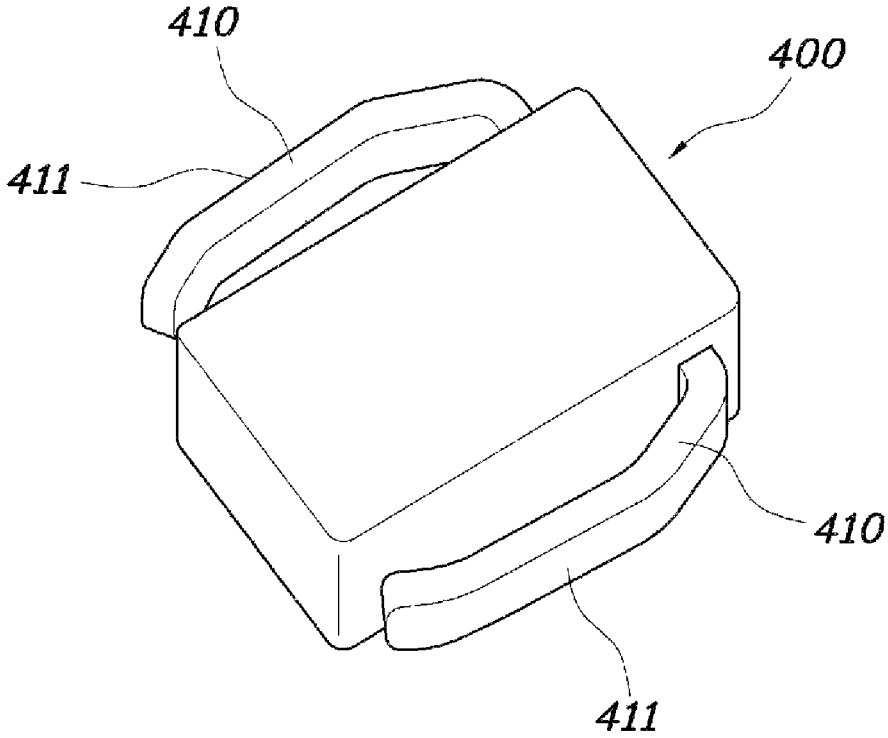
FIG. 3 is an enlarged view illustrating portion "A" of FIG. 1.

As shown in FIGS. 1 to 3, a condenser connector for a vehicle according to the present invention is constructed so that a condenser 400 is mounted to a housing 100 to which a terminal 200 is secured, thus effectively improving noise eliminating/reducing performance.

In detail, the housing 100 is provided with an insertion part 110 so that the terminal 200 and a holder 300 are inserted into the insertion part 110. The insertion part 110 has openings 110*a* and 110*b* which are open at front and rear portions thereof. The holder 300 is fitted into the front opening 110*a*, while the terminal 200 is fitted into the rear opening 110*b*.

Here, since the fitting structure of the holder 300 and the terminal 200 which are inserted into the insertion part 110 is equal to a general fitting structure between a fitting hole and a fitting protrusion which have corresponding shapes, the detailed description will be omitted herein.

The terminal 200 passing through the interior of the housing 100 is exposed through the front opening 110*a* of the insertion part 110. Thus, the terminal 200 exposed through the insertion part 110 of the housing 100 may be electrically connected to a corresponding terminal. For example, if the terminal 200 exposed through the insertion part 110 of the housing 100 is a female terminal, a corresponding terminal electrically connected to the terminal 200 can be a male terminal. Further, if the terminal 200 exposed through the insertion part 110 of the housing 100 is a male terminal, a corresponding terminal electrically connected to the terminal 200 can be a female terminal.

According to this embodiment, the terminal 200 having the construction of the female terminal has been described. However, the construction mounting the condenser 400 to the housing 100 may be applied to the male terminal as well as to the female terminal.

In the state where a wire 201 is secured to one end of the terminal 200, the other end is fitted into the rear portion of the insertion part 110. The terminal 200 includes a power terminal 200*a* to which a power wire 201*a* is connected, a ground terminal 200*b* to which a ground wire 201*b* is connected, and a signal terminal 200*c* to which a signal wire 201*c* is connected for the transmission of a signal. Of course, the terminal 200 may include only the power terminal 200*a* and the ground terminal 200*b* without the signal terminal 200*c*.

Especially, since the power terminal 200*a* and the ground terminal 200*b* are placed on opposite sides of the condenser 400 and are in contact with the condenser 400 via contact terminals 410, noise may be eliminated or reduced from the power wire 201*a* and the ground wire 201*b*. As such, because the condenser 400 is provided at the nearest (or virtually nearest) position to a noise source from which noise is generated, noise eliminating/reducing performance is effectively improved.

The holder 300 functions to hold the condenser 400 to mount it to the housing 100. The external shape of the holder 300 corresponds to the internal shape of the insertion part 110 of the housing 100 to permit easy assembly. The holder 300 is fitted into the front opening 110*a* of the insertion part 110.

The condenser 400 functions to eliminate or reduce noise, and has on opposite sides thereof the contact terminals 410 which are in contact with the terminal 200. Particularly, each contact terminal 410 is formed to be curved in the shape of a bow and maintain tension in the form of a plate spring. This allows the bow-shaped contact terminal 410 to be in contact with and elastically support the terminal 200 when each contact terminal 410 is in contact with the terminal 200, thus ensuring effective contact between the contact terminal 410 and the terminal 200. Here, a portion of the contact terminal 410 contacting the terminal 200 may comprise a flat surface 411 so that the contact terminal 410 is in surface contact with the terminal 200.

Figure 4A:
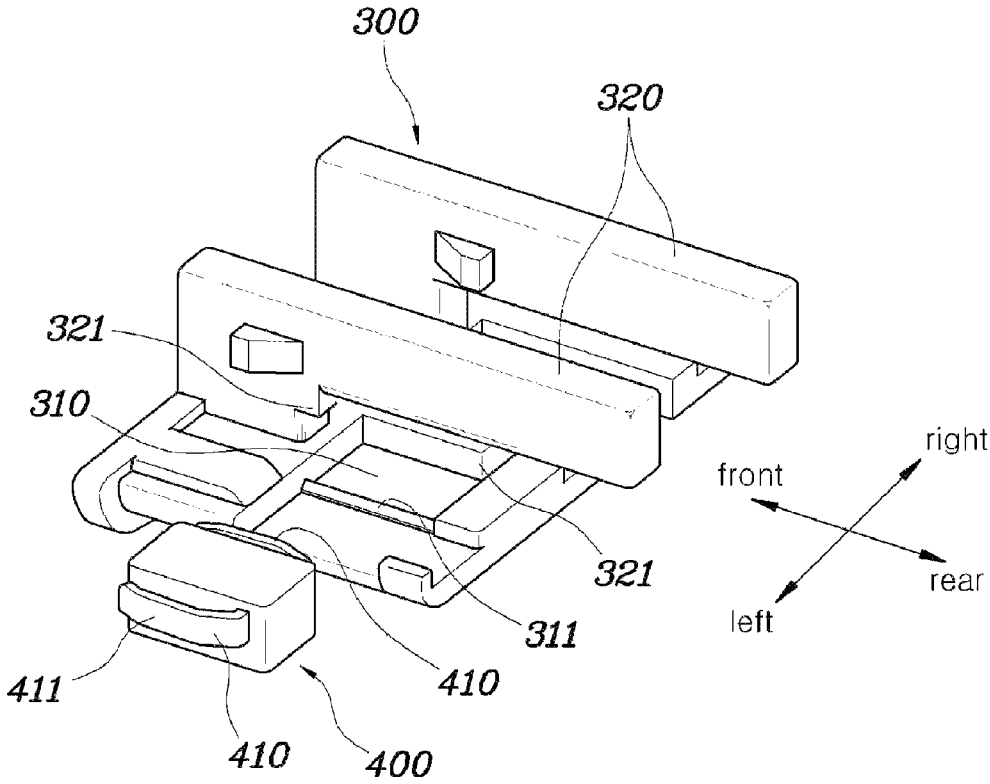
FIG. 4A is a perspective view illustrating the coupled state of the holder and the condenser of the condenser connector according to the present invention.
Figure 4B:
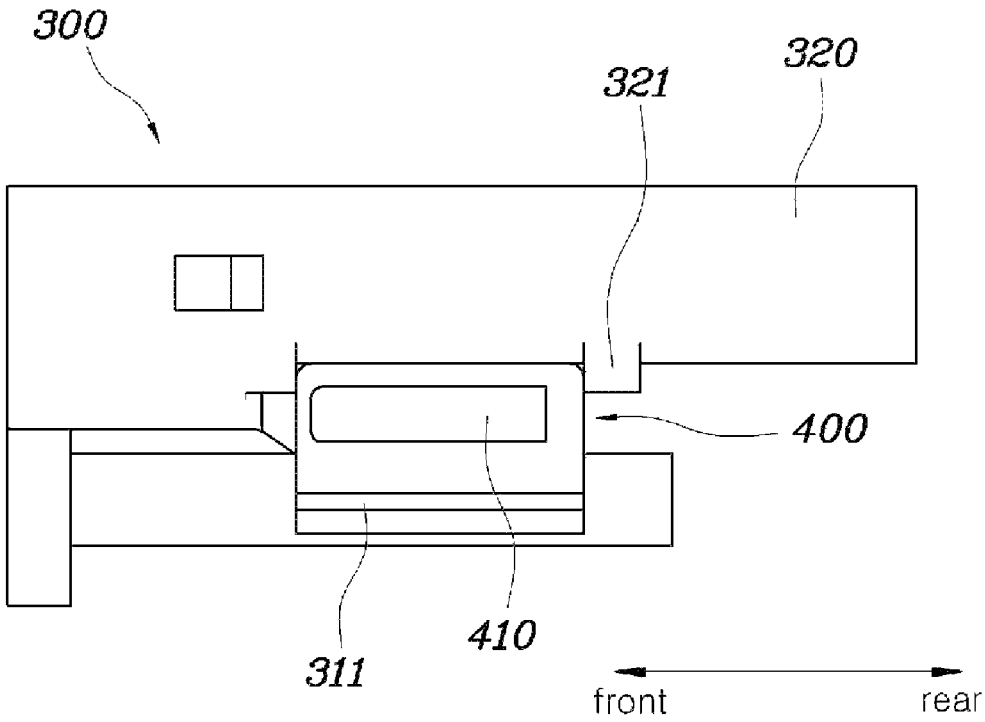
FIG. 4B is a side view illustrating the coupled state of the holder and the condenser of the condenser connector according to the present invention.

As shown in FIGS. 4A and 4B, a seat 310 is provided in the holder 300 to hold the condenser 400. The seat 310 has the shape of a concave depression which corresponds to the shape of the lower portion of the condenser 400.

Further, support protrusions 320 protrude from the holder 300 to support the upper portion of the condenser 400 seated in the seat 310. Thus, if the condenser 400 is inserted into the holder 300, the lower portion of the condenser 400 is supported by the seat 310, and the upper portion of the condenser 400 is supported by the support protrusions 320, so that the condenser 400 can be stably mounted in the holder 300.

A locking step 311 is provided on the edge of the seat 310 in the holder 300, and a pair of support steps 321 is provided on each support protrusion 320 of the holder 300 in such a way as to be spaced apart from each other. The stop step 311 prevents the condenser 400 seated in the seat 310 from being escaped rightwards or leftwards, and the pair of locking steps 321 prevents the condenser 400 positioned in a space between the locking steps 321 from being escaped forwards or backwards.

Meanwhile, an inner seal 120 may be mounted to the housing 100 to surround the insertion part 110. The inner seal 120 is disposed between the housing 100 and the insertion part 110 to seal the insertion part 110, thus protecting the terminal 200 and the condenser 400 installed in the insertion part 110 from the exterior.

The operation of assembling the present invention constructed as described above will be described below.

As shown in FIGS. 4A and 4B, first, the condenser 400 is inserted laterally to be positioned in the seat 310 of the holder 300. That is, the condenser 400 is pushed laterally from the stop step 311 which is formed on the edge of the seat 310 so that the condenser 400 is seated in the seat 310. At this time, the condenser 400 enters between the pair of locking steps 321 provided on each support protrusion 320. Thereby, the rightward or leftward removal of the condenser 400 seated in the seat 310 is prevented by the stop step 311, and the forward or backward removal of the condenser 400 is prevented by the locking steps 321.

As such, after the condenser 400 is mounted to the holder 300, the holder 300 to which the condenser 400 is mounted and the terminal 200 to which the wire 201 is secured are fitted into the insertion part 110 of the housing 100.

Figure 5A:
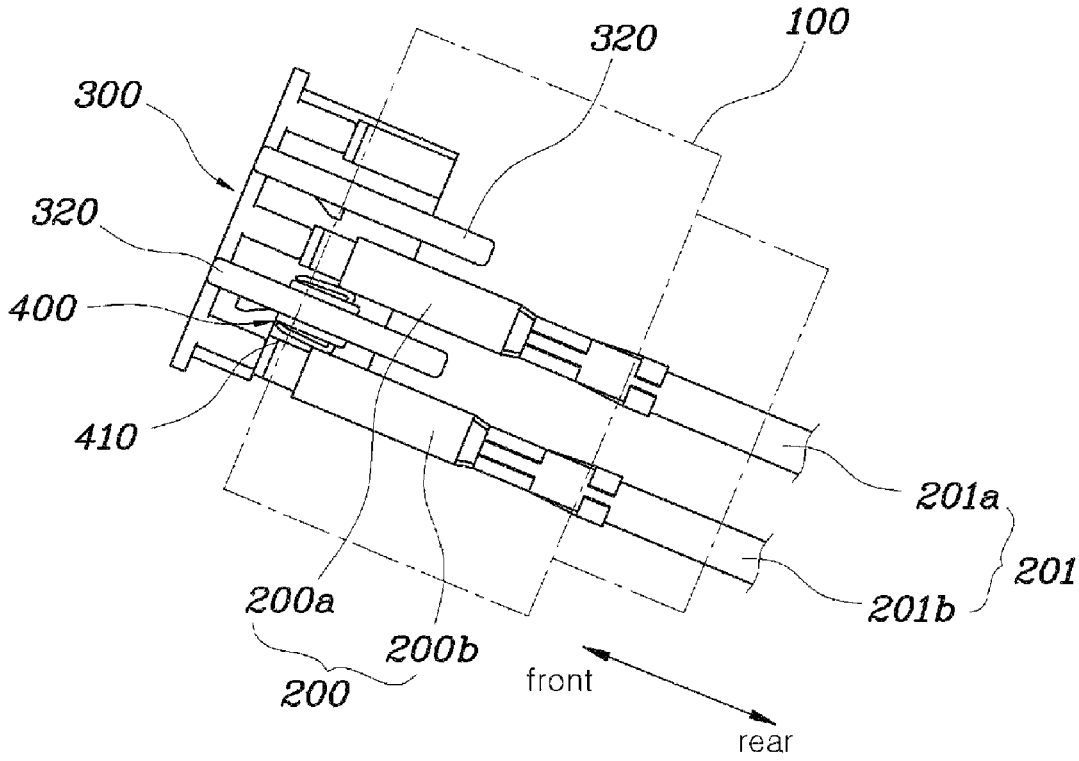
FIG. 5A is a plan view illustrating the state before the terminal and the condenser of the condenser connector according to the present invention are coupled to each other.
Figure 5B:
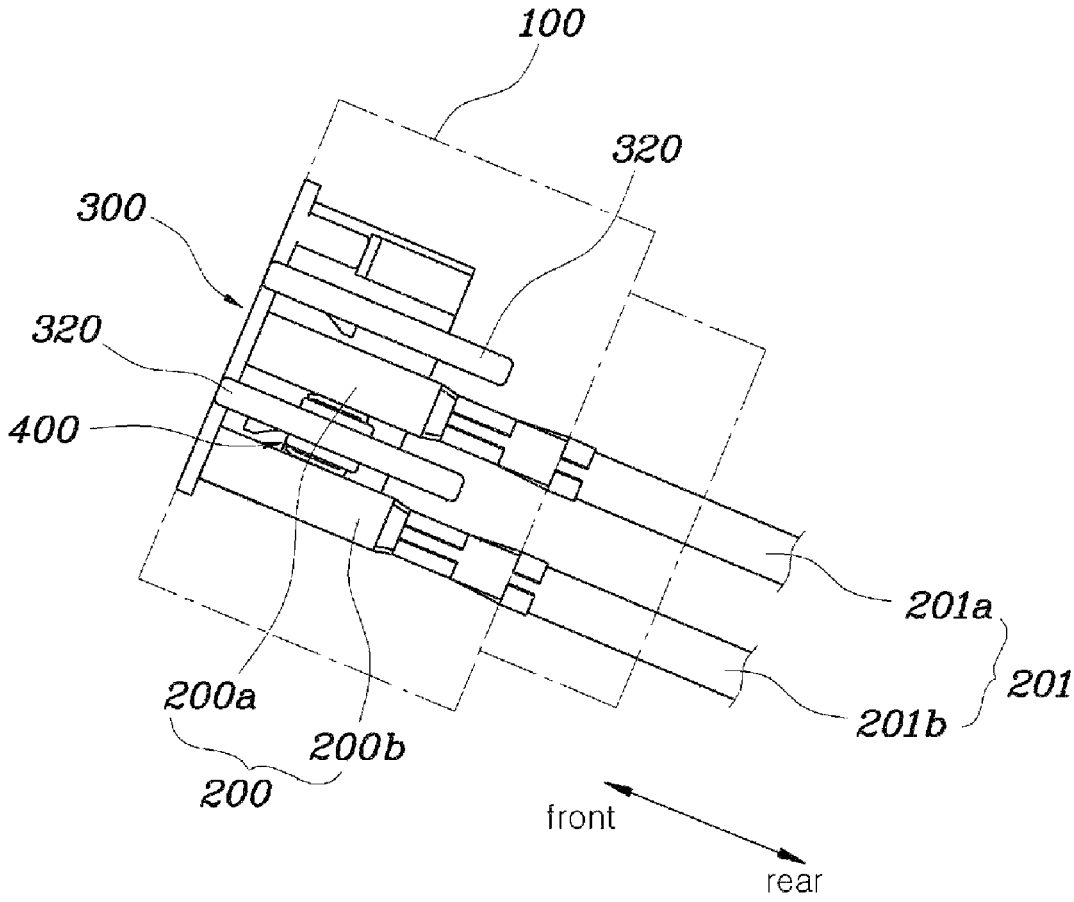
FIG. 5B is a plan view illustrating the state after the terminal and the condenser of the condenser connector according to the present invention have been coupled to each other.
Figure 6:
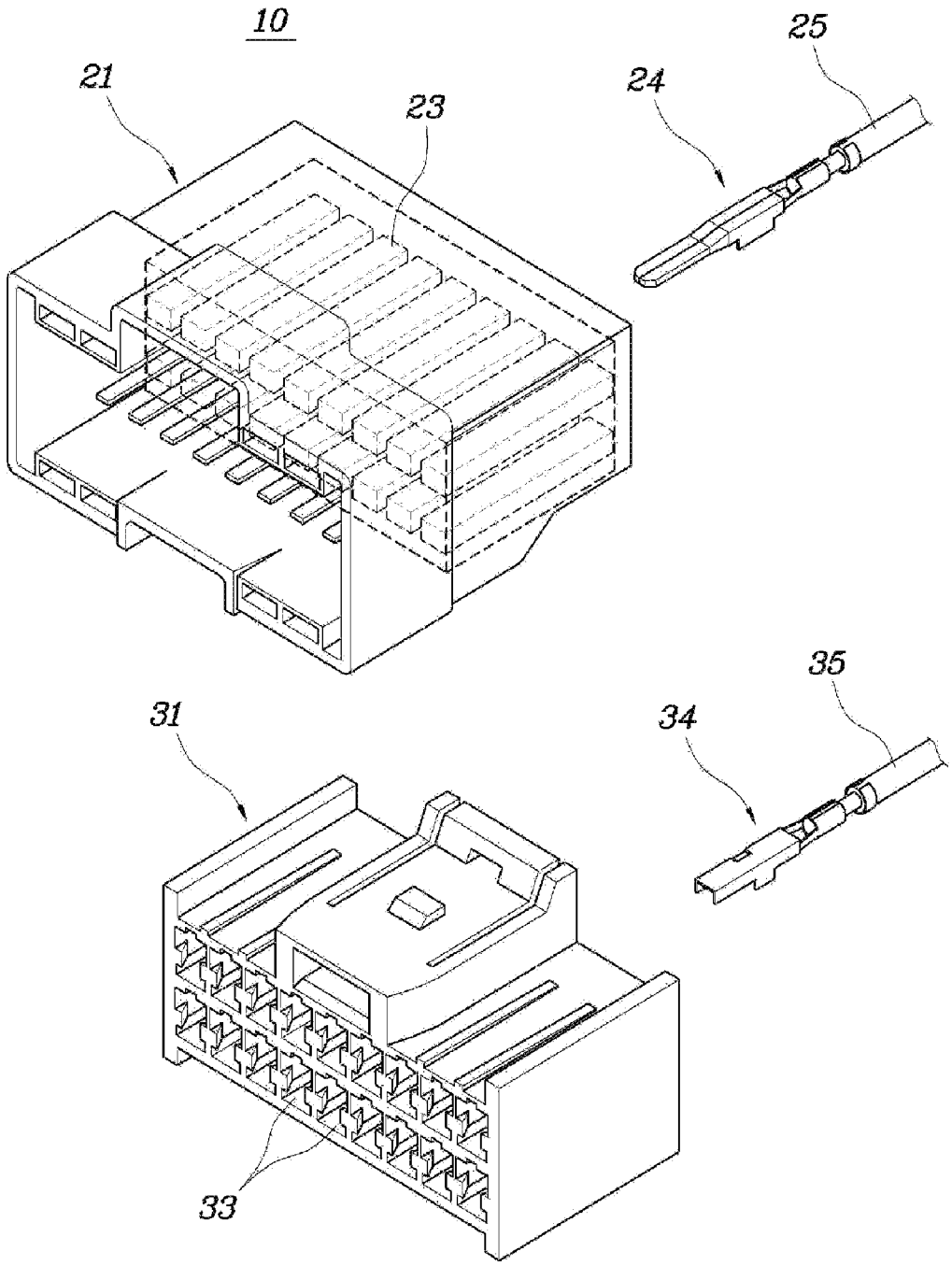
FIG.6(Prior Art )
FIG. 6 is a perspective view illustrating a conventional connector for a vehicle.

That is, as shown in FIGS. 5A to 5B, in the state where the terminal 200 is inserted into the insertion part 110 of the housing 100, the holder 300 is inserted into the insertion part 110 so that each contact terminal 410 of the condenser 400 is in contact with the terminal 200. Here, the bow-shaped contact terminal 410 is in contact with the terminal 200 while elastically supporting the terminal 200. Particularly, since the flat surface 411 of each contact terminal 410 is in surface contact with the terminal 200, the terminal 200 can be stably connected to the contact terminal 410.

As is apparent from the above description, the condenser connector for a vehicle according to the present invention provides the advantage in that a condenser is installed at the nearest or virtually nearest position to a noise source at which noise is generated, thus effectively improving the noise eliminating/reducing performance of the condenser.

Further, the condenser connector for a vehicle according to the present invention provides the advantage in that a condenser for eliminating/reducing noise is installed in the connector, thus solving the problem occurring in the related art which has many restrictions on a layout because the condenser is exteriorly installed to the electronic component of an engine, and also being advantageous for the design of a product.

Although the preferred embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A condenser connector for a vehicle, comprising:

a housing including an insertion part;

a terminal a first end of which is connected to a wire and a second end of which is fitted into and secured to a first end of the insertion part;

a holder fitted into and secured to a second end of the insertion part; and a condenser including a contact terminal which is in contact with the terminal and mounted to the holder, wherein the holder has a seat corresponding to a shape of a lower portion of the condenser so that the condenser is seated in the seat, and a support protrusion protrudes from the seat to support an upper portion of the condenser seated in the seat.

2. The condenser connector as set forth in claim 1, wherein a stop step is provided on an edge of the seat in the holder to prevent the condenser seated in the seat from being escaped rightwards or leftwards, and a pair of locking steps is provided on the support protrusion in such a way as to be spaced apart from each other and prevents the condenser seated in the seat from being escaped forwards or backwards.

3. The condenser connector as set forth in claim 1, wherein the contact terminal is provided on each of opposite sides of the condenser and curved in a shape of a bow to be in elastic contact with the terminal.

4. The condenser connector as set forth in claim 3, wherein the contact terminal has a flat surface which is in surface contact with the terminal.

5. The condenser connector as set forth in claim 1, wherein the terminal comprises a power terminal and a ground terminal which are placed on the opposite sides of the condenser to be in contact with the contact terminal.

6. The condenser connector as set forth in claim 5, wherein the terminal further comprises a signal terminal to transmit a signal.

* * * * *